US012631416B2

(12) United States Patent
Grob

(10) Patent No.: US 12,631,416 B2
(45) Date of Patent: May 19, 2026

(54) SUPPRESSION SYSTEMS FOR FIREARMS

(71) Applicant: KGM TECHNOLOGY GROUP, INC., Peachtree Corners, GA (US)

(72) Inventor: Kyle Grob, Woodstock, GA (US)

(73) Assignee: KGM TECHNOLOGY GROUP, INC., Peachtree Corners, GA (US)

( * ) Notice: Subject to any disclaimer, the term of this patent is extended or adjusted under 35 U.S.C. 154(b) by 70 days.

(21) Appl. No.: 18/728,122

(22) PCT Filed: Jan. 10, 2023

(86) PCT No.: PCT/US2023/060384
§ 371 (c)(1),
(2) Date: Jul. 11, 2024

(87) PCT Pub. No.: WO2023/137270
PCT Pub. Date: Jul. 20, 2023

(65) Prior Publication Data
US 2025/0093120 A1 Mar. 20, 2025

Related U.S. Application Data

(60) Provisional application No. 63/299,726, filed on Jan. 14, 2022.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36; F41A 21/38; F41A 21/00
See application file for complete search history.

(56) References Cited

U.S. PATENT DOCUMENTS

| | | | | |
|---|---|---|---|---|
| 4,907,488 | A | 3/1990 | Seberger | |
| 6,374,718 | B1 | 4/2002 | Rescigno et al. | |
| 9,879,933 | B2 * | 1/2018 | Myers | F41A 21/48 |
| 11,397,065 | B2 * | 7/2022 | Vanhatalo | F41A 21/325 |
| 2010/0180759 | A1 | 7/2010 | Petersen | |
| 2017/0191779 | A1 | 7/2017 | Myers | |
| 2017/0299311 | A1 * | 10/2017 | Daniel | F41A 5/26 |
| 2018/0202744 | A1 | 7/2018 | De Sousa | |
| 2021/0102774 | A1 | 4/2021 | Vanhatalo et al. | |

FOREIGN PATENT DOCUMENTS

GB 190806680 A 2/1909

OTHER PUBLICATIONS

International Search Report and Written Opinion for PCT/US23/60384 dated Jun. 29, 2023, 18 pages.

* cited by examiner

*Primary Examiner* — Jonathan C Weber
(74) *Attorney, Agent, or Firm* — Fox Rothschild LLP

(57) ABSTRACT

The present disclosure relates to a suppression system for a firearm, including: a barrel having first and second portions, wherein a wall thickness of the second portion is less than that of the first portion; and an integrally mounted suppressor.

17 Claims, 10 Drawing Sheets

SUPPRESSION SYSTEMS FOR FIREARMS

CROSS-REFERENCE TO RELATED APPLICATION

This application is a U.S. national phase application under 35 U.S.C. § 371 of International Patent Appl. No. PCT/US23/60384 filed Jan. 10, 2023, which claims the benefit of priority to U.S. Provisional Patent Appl. No. 63/299,726 filed Jan. 14, 2022, the disclosures of all of which are hereby incorporated by reference in their entireties.

BACKGROUND

A firearm creates a loud noise, or report, and a flash when a round of ammunition is discharged from the firearm. It is often desirable to reduce the noise and flash associated with the discharge of a firearm. For example, in military applications, the noise and flash can reveal the location of the shooter, thereby placing the shooter at a tactical disadvantage during combat operations.

Suppressors often are used to reduce the noise and muzzle flash generated during discharge of a firearm. A suppressor typically is coupled to the muzzle end of the firearm's barrel, and includes a series of expansion chambers that capture and/or redirect the gas and soundwaves expelled from the barrel. The use of a suppressor, however, adds weight to the firearm. Also, because the suppressor typically is attached to the muzzle end of the barrel, the weight of the suppressor can have a significant adverse impact on the balance of the firearm. The added weight, and its effect on the balance of the firearm, can negatively affect user comfort and shooting accuracy.

SUMMARY

In one aspect, the disclosed technology relates to a suppression system for a firearm, including: a barrel having a first portion and a second portion, wherein: the first portion and the second portion define a bore configured to receive a projectile upon discharge of the firearm; and a wall thickness of the second portion of the barrel is less than a wall thickness of the first portion of the barrel; and a suppressor including: a first mount configured to be connected to a first end of the second portion of the barrel; a second mount configured to be connected to a second end of the second portion of the barrel; a cylindrical outer body connected to the second mount; and a first baffle and a second baffle disposed within the outer body and defining an expansion chamber in fluid communication with the bore, wherein the first and second baffles are coupled to the outer body and the second mount so that the first and second baffles are configured to translate in relation to the outer body, and the translation of the first and second baffles in relation to the outer body urges the first mount toward the second mount.

In some embodiments, the urging of the first mount toward the second mount compresses the distal portion of the barrel. In some embodiments, the second baffle is configured to be threadably coupled to the outer body so that rotation of the second baffle in relation to the outer body causes the first and the second baffles to translate linearly in relation the outer body.

In some embodiments, the rotation of the second baffle in relation to the outer body causes the first and the second baffles to translate in a first direction in relation the outer body, and produces a force on the outer can acting in a second direction opposite the first direction. In some embodiments, the force on the outer can is transmitted to the second end of the distal portion of the barrel by way of the second mount, and urges the second end of the distal portion of the barrel in the second direction. In some embodiments, the force on the outer can places the outer can in tension. In some embodiments, the suppressor further includes a cylindrical inner can attached to the first mount and coupled to the second baffle, the inner can being configured to urge the first mount toward the second mount.

In some embodiments, the expansion chamber is a first expansion chamber; and the suppressor further includes: a third baffle coupled to the second baffle, the second and third baffles defining a second expansion chamber in fluid communication with first expansion chamber; a fourth baffle coupled to the third baffle, the third and fourth baffles defining a third expansion chamber in fluid communication with second expansion chamber; and a fifth baffle coupled to the fourth baffle, the fourth and fifth baffles defining a fourth expansion chamber in fluid communication with third expansion chamber. In some embodiments, the inner can, the second mount, and the fifth baffle define a fifth expansion chamber in fluid communication with the fourth expansion chamber. In some embodiments, the first mount defines a sixth expansion chamber in fluid communication with the fifth expansion chamber and the bore of the barrel.

In some embodiments, the outer body, the inner can, the second mount, and the fifth baffle define a seventh expansion chamber in fluid communication with the fourth expansion chamber and the fifth expansion chamber. In some embodiments, the fourth baffle, the fifth baffle, and the outer body define an eighth expansion chamber located radially outward of the fourth expansion chamber and in fluid communication with the third, fourth, and seventh expansion chambers; the third baffle, the fourth baffle, and the outer body define a ninth expansion chamber located radially outward of the third expansion chamber and in fluid communication with the second, third, and eighth expansion chambers; the second baffle, the third baffle, and the outer body define a tenth expansion chamber located radially outward of the second expansion chamber and in fluid communication with the first, second, and ninth expansion chambers; and the first baffle, the second baffle, and the outer body define an eleventh expansion chamber located radially outward of the first expansion chamber and in fluid communication with the first and tenth expansion chambers.

In some embodiments, the suppressor further includes an end cap connected to the outer body, wherein the end cap and the first baffle define a twelfth expansion chamber in fluid communication with the first and the tenth expansion chambers. In some embodiments, the first and second baffles define a bore configured to receive the projectile upon discharge of the firearm; and the bore defined by the suppressor is aligned with, and is in fluid communication with the bore defined by the barrel. In some embodiments, the first end of the second portion of the barrel is a muzzle of the barrel. In some embodiments, the first portion of the barrel is configured to be connected to a receiver of the firearm. In another aspect, the disclosed technology relates to a firearm including the suppression system disclosed herein.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

Figure 1:
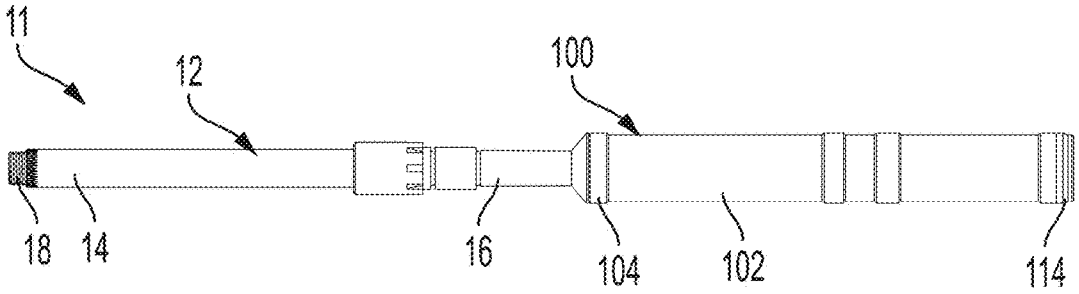
FIG. 1 is a side view of an embodiment of a suppression system for a firearm.
Figure 2:
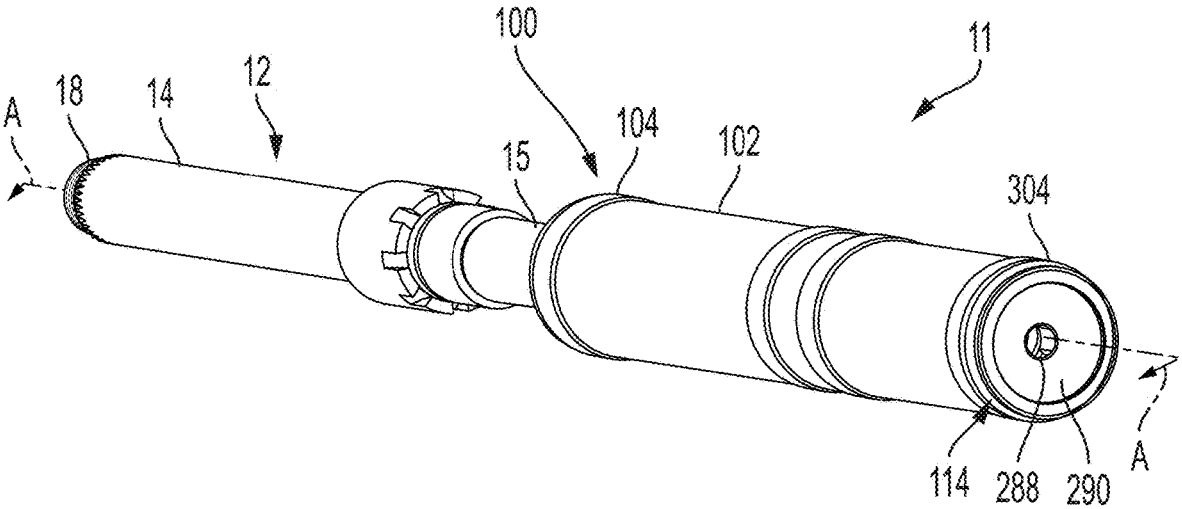
FIG. 2 is a front perspective view of the suppression system shown in FIG. 1.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

Certain relationships between features of the suppressor are described herein using the term "substantially" or "substantially equal." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" indicates that the orthogonal relationship is not a strict relationship and does not exclude functionally similar variations therefrom.

As used herein, the term "distal," unless otherwise indicated, refers to a direction or location relatively close, or closer to, the muzzle, or upstream end of a firearm. As used herein, the term "proximal," unless otherwise indicated, refers to a direction or location relatively close, or closer to, the end of the buttstock, or downstream end, of the firearm.

A suppression system 11 for use with a firearm 10 is disclosed. As used herein, the term "firearm" may refer to a rifle, shotgun, pistol, or other such weapon, including semi-automatic and automatic firearms. The suppressor technology disclosed herein can be used with all such firearms. The embodiment of the firearm 10 disclosed herein is an M2HB Browning machine gun. This particular application is disclosed for illustrative purposes only, as the suppression system 11 can be adapted for use with other types of firearms.

In one embodiment, the firearm 10 has the suppression system 11 mounted thereon. The suppression system 11 includes a suppressor 100, and a barrel 12 through which a projectile may be fired. The suppressor 100 is configured to be mounted on the barrel 12, as can be seen in FIGS. 1-4. The suppressor 100 diverts the exhaust gas generated during discharge of the firearm 10 into multiple, separate expansion chambers. More specifically, as the projectile travels through a bore 101 of the suppressor 100, e.g., an extended aligned aperture extending through suppressor 100, the exhaust gas diverts into different expansion chambers of suppressor 100, which in turn causes the exhaust gas to lose velocity and pressure prior to exiting the suppressor 100. The bore 101 is denoted in FIG. 3.

Figure 3:
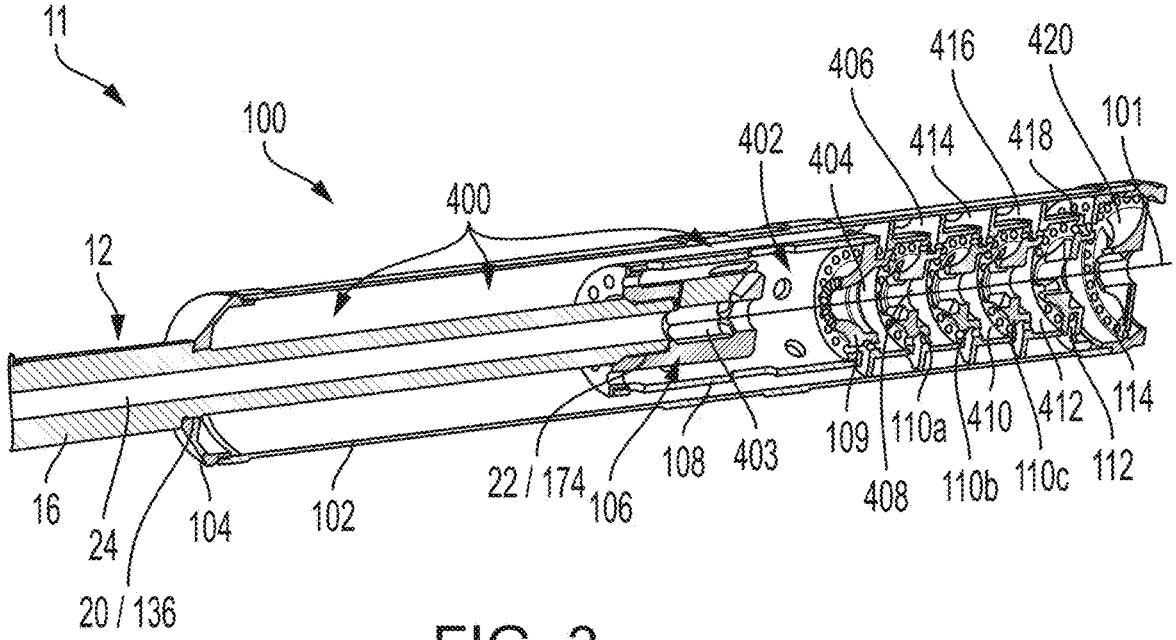
FIG. 3 is a longitudinal cross-sectional view of the suppression system shown in FIGS. 1 and 2, taken through the line "A-A" of FIG. 2.

FIG. 3 is a cross-sectional side view of the suppressor 100 in an assembled state, and installed on the barrel 12. As can be seen in FIG. 3, the suppressor 100 is mounted on, and surrounds a second, or distal portion 16 of the barrel 12. As discussed below, the mechanical configuration of the suppressor 100 permits the distal portion 16 of the barrel 12 to have a relatively thin wall thickness, while retaining sufficient strength to withstand the stresses that arise normally during discharge of the firearm 10. The reduction in wall thickness lowers the weight of the barrel 12, which in turn cause the weight and the balance of the firearm 10 to remain equivalent those of the same firearm equipped with a conventional barrel, and without a suppressor.

As can be seen in FIG. 3, the suppressor 100 comprises a body, or outer can 102; a first, or internal mount 106; a second, or external mount 104; and an inner can 108. The suppressor 100 further comprises a proximate, or blast baffle 109, or fifth baffle; a first intermediate baffle 110*a*, or fourth baffle; a second intermediate baffle 110*b*, or third baffle; a third intermediate baffle 110*c*, or second baffle; a distal baffle 112, or first baffle; and an end cap 114.

Outer Can

Figure 5:
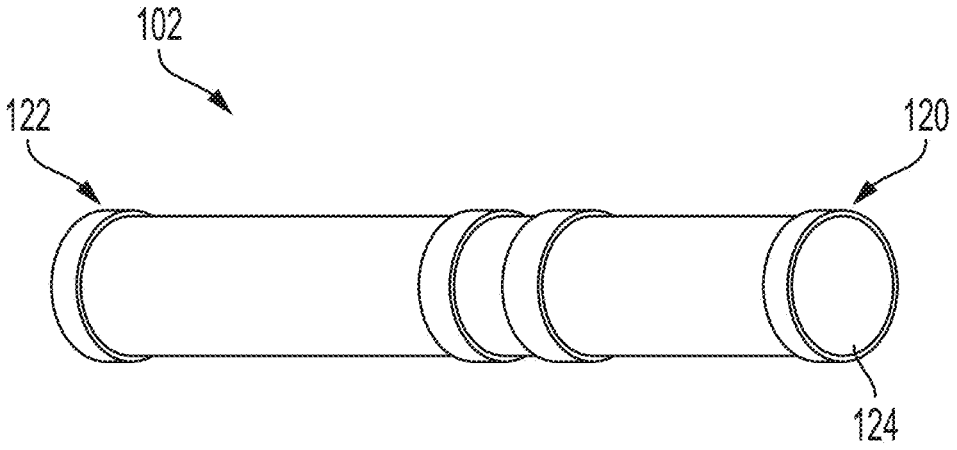
FIG. 5 is a front perspective view of an outer can of the suppression system shown in FIGS. 1-3.
Figure 6:
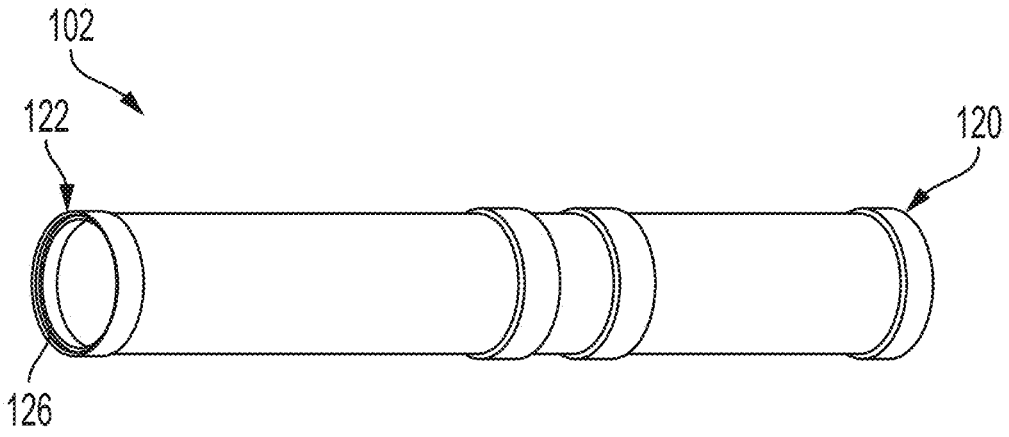
FIG. 6 is a rear perspective view of the outer can shown in FIG. 5.

Referring to FIGS. 5 and 6, the outer can or outer body 102 has a generally cylindrical configuration, and incudes a downstream, or distal end 120 and an upstream, or proximal end 122. Threads 124 are formed on and extend along an inner circumference of the distal end 120. Threads 126 likewise are formed on and extend along an inner circumference of the proximal end 122. The outer can 102, along with the external mount 104, the distal baffle 112, and the end cap 114, define the exterior of the suppressor 100.

As can be seen in FIG. 3, the interior surface of the outer can 102, in combination with the external mount 104, the internal mount 106, the inner 108, and the blast baffle 109, define an expansion chamber 400, or seventh expansion chamber, within the suppressor 100.

External Mount

Figure 19:
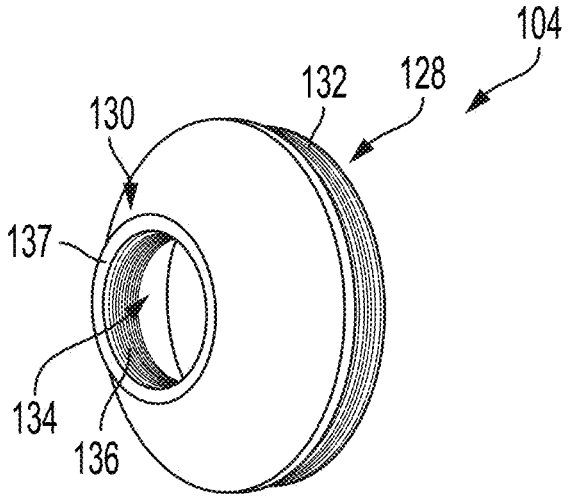
FIG. 19 is a rear perspective view of an external mount of the suppression system shown in FIGS. 1-3.
Figure 20:
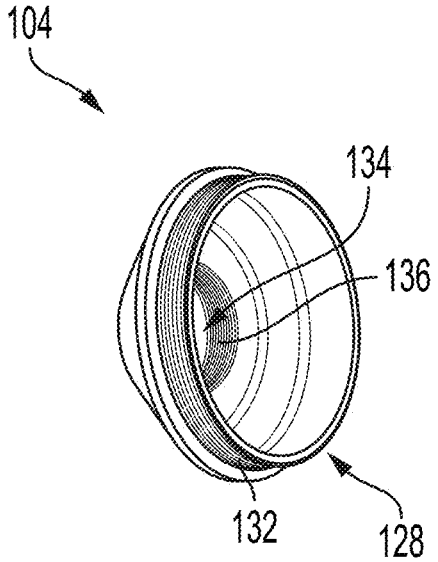
FIG. 20 is a front perspective view of the external mount shown in FIG. 19.

Referring to FIGS. 19 and 20, the first, or external mount 104 has a generally frustoconical configuration. The external mount 104 has a distal end 128, and a proximal end 130. Threads 132 are formed along an external circumference of the distal end 128. A circular aperture 134 is formed in the proximal end 130. Threads 136 are formed along the circumference of the aperture 134. As discussed below, the threads 136 are configured to engage corresponding exterior threads 20 on the proximal end 32 of the distal portion 16 of the barrel 12, to attach the suppressor 100 to the barrel 12.

Figure 4:
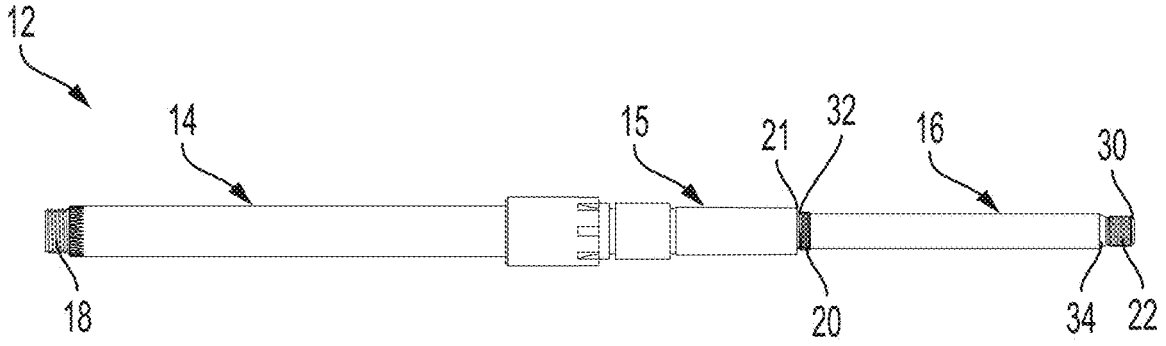
FIG. 4 is a side view of a barrel of the suppression system shown in FIGS. 1-3.

The proximal end 130 of the external mount 104 has an end face 137 that faces in the proximal, or upstream direction. The end face 137 engages a surface 21 on the barrel 12 that faces in the distal, or downstream direction, as the external mount 104 is tightened onto the barrel 12. The surface 21 is depicted in FIG. 4. The surface 21 thus acts as a rotational stop for the external mount 104. Also, friction between the end face 137 and the surface 21 helps to secure the external mount 104 to the barrel 12, and to maintain a rigid connection between the external mount 104 and the barrel 12. The external mount 104 can be further secured the barrel 12 by welding.

The threads 132 on the distal end 128 of the external mount 104 are configured to engage the internal threads 116 on the proximal end 122 of the outer can 102, the secure the external mount to the outer can 102.

Inner Can

Figure 9:
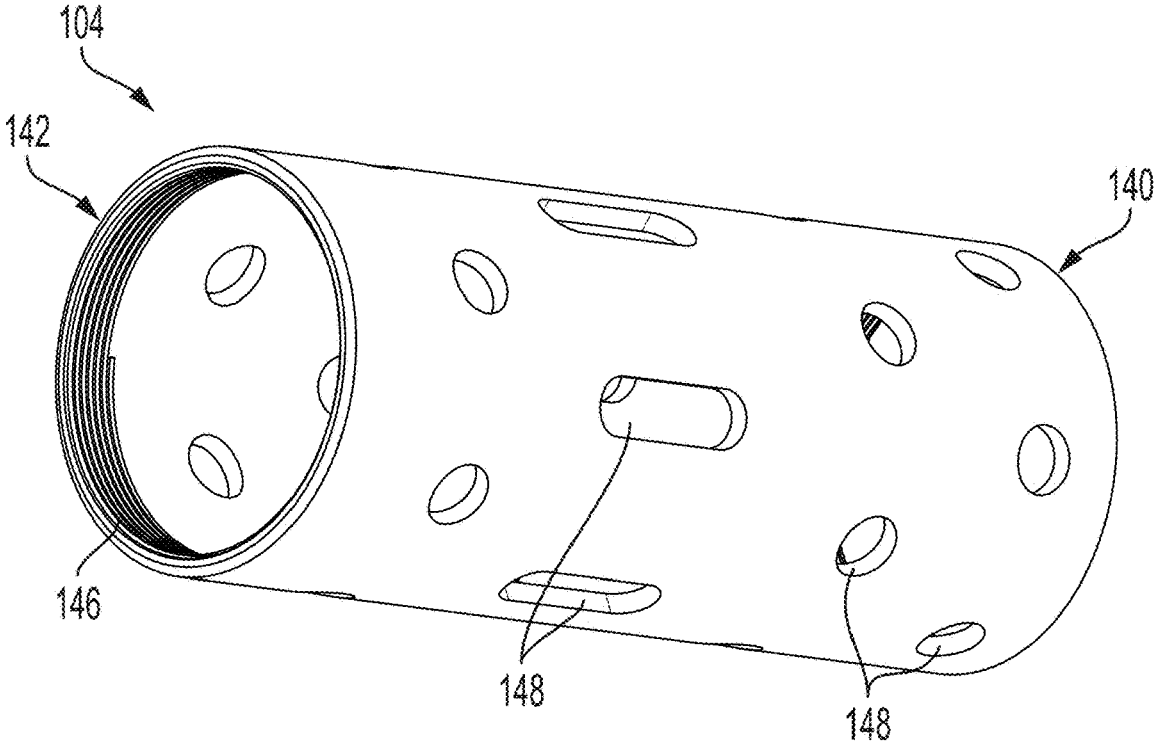
FIG. 9 is a rear perspective view of a blast baffle of the suppression system shown in FIGS. 1-3.
Figure 10:
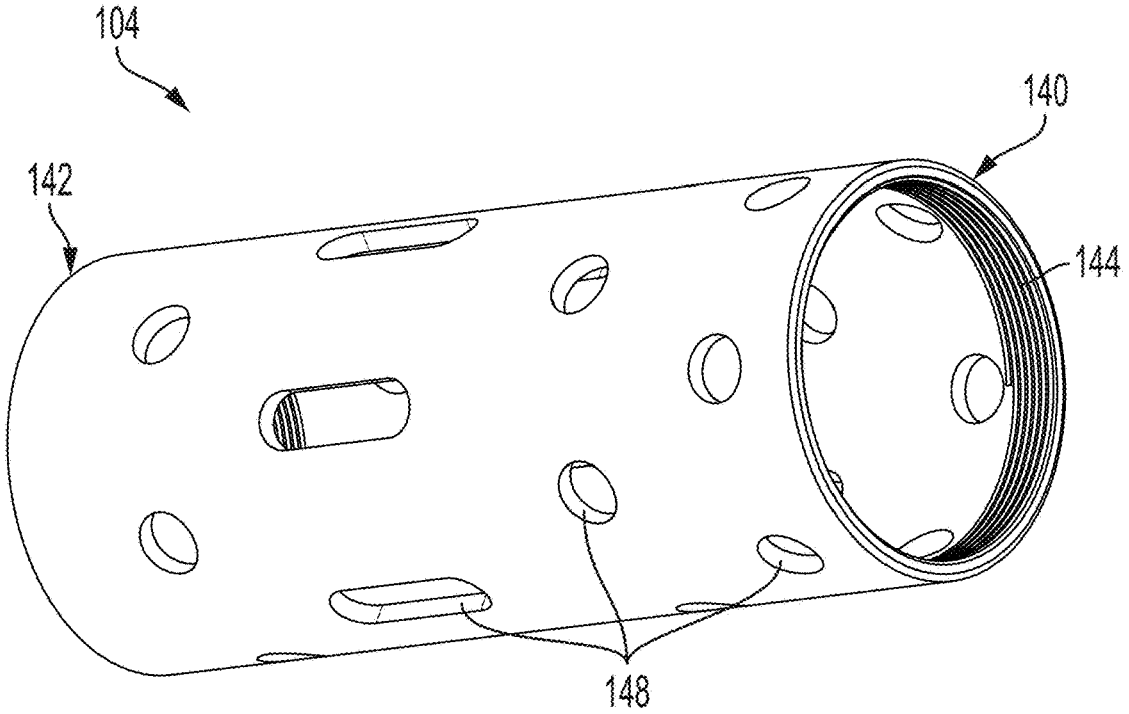
FIG. 10 is a front perspective view of the blast baffle shown in FIG. 9.

The inner can 108 is positioned within the outer can 102, as can be seen in FIG. 3. Referring to FIGS. 9 and 10, the inner can 108 has a generally cylindrical configuration, and defines an interior volume. The inner can 108 has a distal end 140, and a proximal end 142. Threads 144 are formed on, and extend along an inner circumference of the distal end 140. Threads 146 likewise are formed on, and extend along an inner circumference of the proximal end 142.

The interior surface of the inner can 108, in combination with the internal mount 106 and the blast baffle 109, define an expansion chamber 402, or fifth expansion chamber, depicted in FIG. 3.

As shown in FIGS. 9 and 10, the inner can 108 has a combination of circular and slot-shaped through-wall ports 148 formed therein. The through-wall ports 148 extend between, and facilitate fluid communication between the expansion chamber 402 and the expansion chamber 400.

Internal Mount

Figure 7:
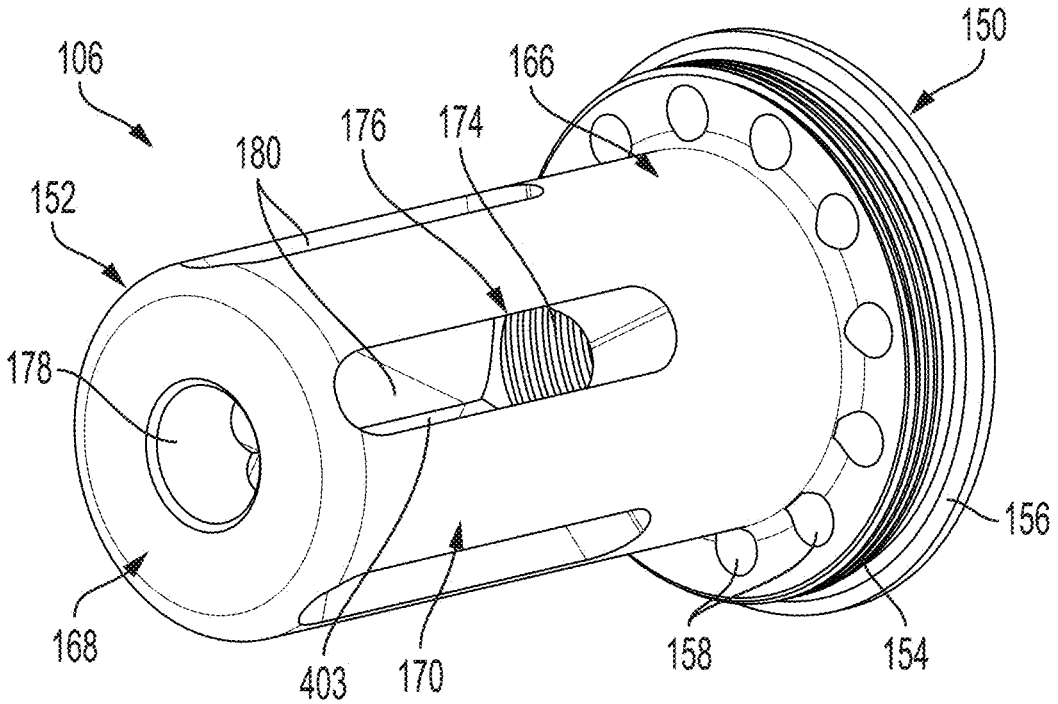
FIG. 7 is a rear perspective view of an internal mount of the suppression system shown in FIGS. 1-3.
Figure 8:
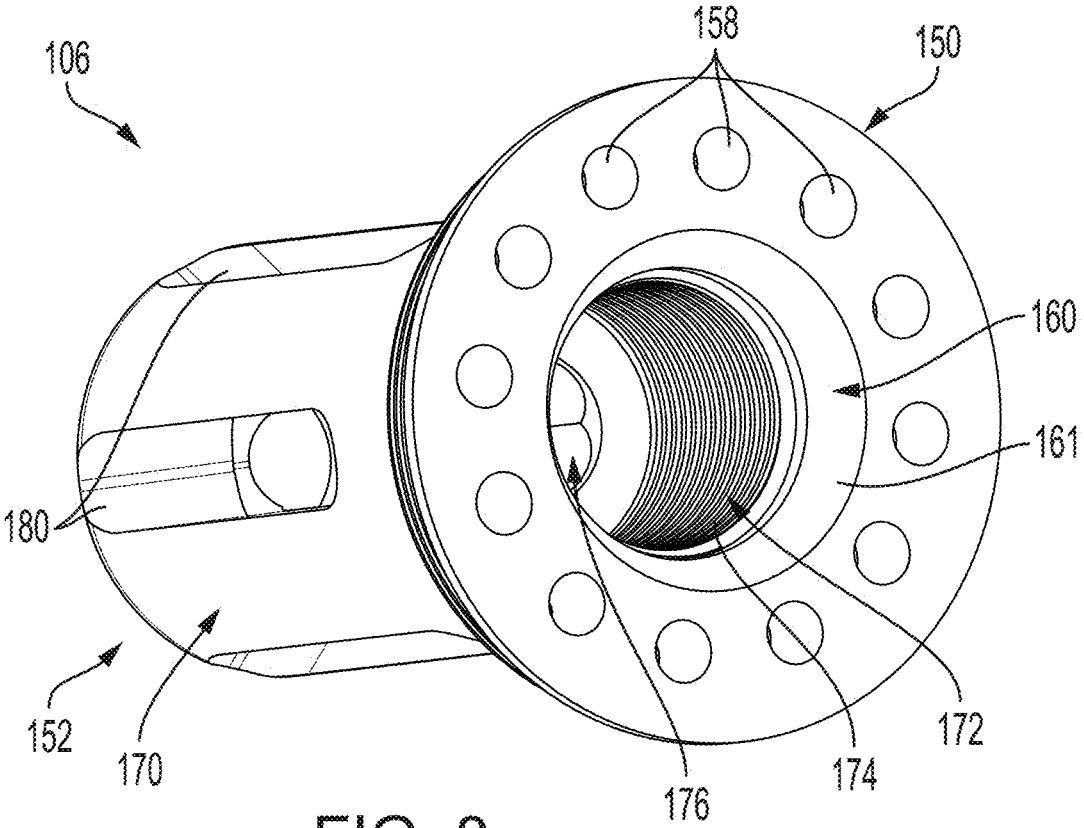
FIG. 8 is a front perspective view of the internal mount shown in FIG. 7.

As can be seen in FIG. 3, the second, or internal mount 106 in mounted on, and is disposed in part within the inner can 106. Referring to FIGS. 7 and 8, the internal mount 106 includes a flange 150 and an adjoining body 152. The flange 150 is generally ring-shaped, and has threads 154 formed along an outer circumference thereof. The threads 154 are configured to engage the threads 146 on the proximal end 142 of the inner can 108, to secure the internal mount 106 to the inner can 108. The flange 150 also includes a lip 156. The lip 156 has a tapered surface configured to engage a similarly tapered surface on the proximal end 142 of the inner can 108. Circular through-wall ports 158 are formed in the flange 150. The through-wall ports 158 are axially-oriented, i.e., the through-wall ports 158 extend in the axial, or lengthwise direction of the internal mount 106, and each through-wall port 158 is equally spaced from its adjacent through-wall port 158. The through-wall ports 158 extend between, and facilitate fluid communication between the expansion chamber 402 and the expansion chamber 400.

The flange 150 of the internal mount 106 has an aperture 160 formed therein. The aperture 160 is centrally located, i.e., the aperture 160 is disposed symmetrically about the axial centerline of the internal mount 106, and is bounded by a tapered surface 161 of the flange 150. As discussed below, the aperture 160 receives a portion of the barrel 12 of the firearm 10 when the suppressor 100 is mounted on the firearm 10.

The body 152 of the internal mount 106 has a generally cylindrical configuration. The body 152 includes a proximal portion 166 that adjoins the flange 150; a distal portion 168; and a side portion 170 that adjoins, and extends between the proximal portion 166 and the distal portion 168. A centrally-located first aperture 172 is formed in the proximal portion 166. The first aperture 172 adjoins the aperture 160 in the flange 150. Threads 174 are formed along an inner circumference of the first aperture 172. As can be seen in FIG. 3, the threads 174 are configured to engage corresponding threads 22 on a distal end 30 of the distal portion 16 of the barrel 12, to secure the suppressor 100 to the distal end 30 of the distal portion 16 of the barrel 12. Friction between the tapered surface 161 on the flange 150 and a corresponding tapered surface 34 on the distal portion 16 helps to secure the distal end 30 of the distal portion 16 to the internal mount 106.

Referring again to FIGS. 7 and 8, a second aperture 176 is formed in the proximal portion 166, and is symmetrically disposed about the longitudinal axis of the suppressor 100. The second aperture 176 adjoins the first aperture 172. The diameter of the second aperture 176 is less than the diameter of the first aperture 172. More specifically, the diameter of the second aperture 176 is about equal to the diameter of the bore 24 in the barrel 12 of the firearm 10. The second aperture 176 aligns with the bore 24 when the suppressor 100 is mounted on the firearm 10. The second aperture 176 forms part of the bore 101 along which the projectile travels upon entering the suppressor 100.

The side portion 170 defines an expansion chamber 403, or sixth expansion chamber, that is in fluid communication with the second aperture 176. The side portion 170 has slot-shaped through-wall ports 180 formed therein. The ports 180 adjoin, and facilitate fluid communication between the expansion chamber 403 and the expansion chamber 402.

A centrally-located third aperture 178 is formed in distal portion 168 of the body 152. The third aperture 178 is in fluid communication with the expansion chamber 402, and is aligned with the second aperture 176 in the proximal portion 166. The third aperture 178 has a diameter about equal to the diameter of the second aperture 176. The third aperture 178 forms part of the bore 101 along which the projectile travels while passing through the suppressor 100. More specifically, the projectile, upon exiting the bore 24 of the barrel 12, travels through the second aperture 176 and the expansion chamber 403 of the side portion 170, and exits the internal mount 106 through the third aperture 178.

Blast Baffle

Figure 11:
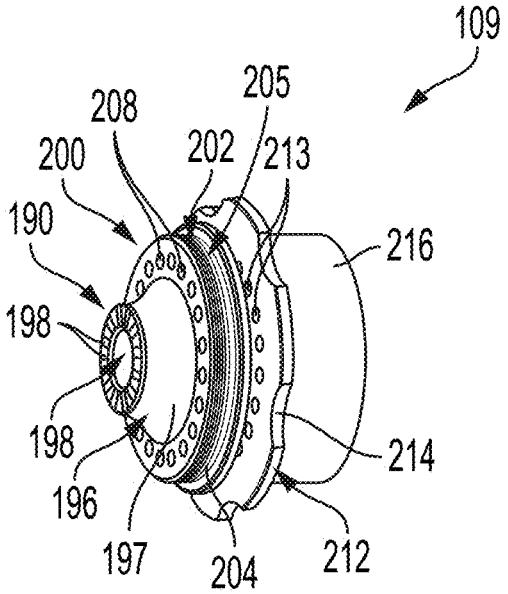
FIG. 11 is a rear perspective view of an inner can of the suppression system shown in FIGS. 1-3.
Figure 12:
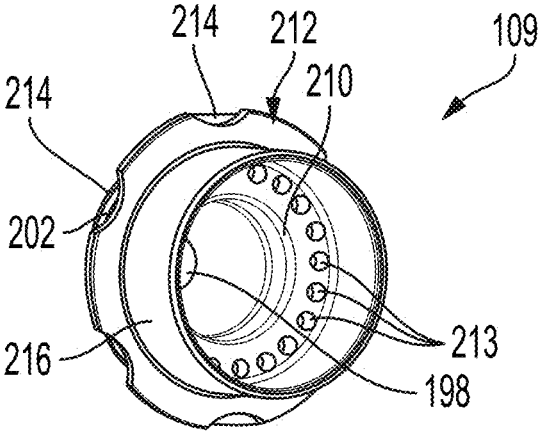
FIG. 12 is a front perspective view of the inner can shown in FIG. 11.

The proximal, or blast baffle 109 is securely attached to the distal end of the inner can 106, as can be seen in FIG. 3. Referring to FIGS. 11 and 12, the blast baffle 109 includes a cone insert 196 having an arcuate, or concave outer surface 197 that is symmetrically disposed about the central axis of the blast baffle 109. For example, the arcuate outer surface 197 can be a concave curved surface with a proximal end portion that extends in a direction parallel or substantially parallel to the central axis of the blast baffle 109, and a distal end portion that extends in a direction orthogonal or substantially orthogonal to the central axis of blast baffle 109.

The cone insert 196 can be formed from a material that is different from the material from which the other parts of the blast baffle 109 are formed, to help reduce muzzle flash. The cone insert 196 extends distally, from a proximal end 190 of the blast baffle 109. An aperture 198 is formed in the cone insert 196. The aperture 198 is aligned with the third aperture 178 of the internal mount 106, and has a diameter about equal to the diameter of the third aperture 178. The aperture 198 forms part of the bore 101 along which the projectile travels. More specifically, the projectile, upon exiting the internal mount 106 by way of third aperture 178, travels through a portion of the expansion chamber 402, and enters the blast baffle 109 by way of the aperture 198.

The proximal end of the cone insert 196 includes a plurality of cutouts 199 formed therein. The cutouts 199 are located adjacent the aperture 198, and help to redirect some of the gas flow reaching the blast baffle 109 across the arcuate outer surface of the cone insert 196.

The blast baffle 109 further includes a proximal flange 200. The proximal flange 200 adjoins, and extends distally, or downstream from the cone insert 196. The proximal flange 200 has threads 202 formed along an outer circumference thereof. The threads 202 are configured to engage the threads 146 on the distal end 42 of the inner can 108, to secure the blast baffle 109 to the inner can 108.

The proximal flange 200 also includes a lip 204. The lip 204 has an outer diameter about equal to the outer diameter of the inner can 108, and abuts the distal end 42 of the inner can 108 when the blast baffle 109 is secured to the inner can 108. The threads 202 and the lip 204 thus form a seat 205 for the distal end of the inner can 108. Also, a plurality of axially-oriented, circular through-wall ports 208 are formed in the proximal flange 200, with each through-wall port 208 being equally spaced from its adjacent through-wall port 208. The through-wall ports 208 extend between, and facilitate fluid communication between the expansion chamber 402 and the expansion chamber 400.

The blast baffle 109 further includes a middle portion 210, visible in FIG. 12. The middle portion 210 adjoins, and extends distally from the proximal flange 200. The middle portion 210 has a cylindrical configuration.

The blast baffle 109 also includes a distal flange 212. The distal flange 212 adjoins, and extends distally from the middle portion 210. The distal flange 212 has an outer diameter that is slightly smaller than an inner diameter of the outer can 102, so that minimal clearance exists between the distal flange 212 and the inner surface of the outer can 102. As can be seen in FIG. 3, the proximal side of the distal flange 212 defines the downstream, or distal end of the expansion chamber 400.

Referring again to FIGS. 10 and 11, a plurality of axially-oriented, circular through-wall ports 213 are formed in the distal flange 212. The circular through-wall ports 213 are located near the inner circumference of the distal flange 212, and each circular through-wall port 213 is equally spaced from its adjacent circular through-wall port 213. Each circular through-wall port 213 aligns with a corresponding through-wall port 208 in the proximal flange 200.

As can be seen in FIG. 3, the blast baffle 109 and the first intermediate baffle 110*a* define an expansion chamber 404, or fourth expansion chamber. The circular through-wall ports 213 in the distal flange 212 of the blast baffle 109 extend between, and facilitate fluid communication between the expansion chamber 400 and the expansion chamber 404. The aperture 198 in the cone insert 196 of the blast baffle 109 extends between, and facilitates fluid communication between the expansion chamber 402 and the expansion chamber 404.

Through-wall ports 214 are formed along the outer circumference of the distal flange 212, with each through-wall port 214 being equally spaced from its adjacent through-wall port 214. Each circular through-wall port 214 is bounded by an arcuate surface of the distal flange 212, so that the outer circumference of the distal flange 212 has a scalloped configuration.

The blast baffle 109, the first intermediate baffle 110*a*, and the outer can 102 define another expansion chamber 406, or eighth expansion chamber, located between the blast baffle 109 and the first intermediate baffle 110*a*. As can be seen in FIG. 3, the expansion chamber 406 is located radially outward of the expansion chamber 404, and is separated from the expansion chamber 404, in part, by a distal portion 216 of the blast baffle 109. The through-wall ports 214 in the distal flange 212 of the blast baffle 109 extend between, and facilitate fluid communication between the expansion chamber 400 and the expansion chamber 406.

A proximal end of the distal portion 216 of the blast baffle 109 adjoins the distal flange 212, so that the distal portion 216 extends downstream, or distally from the distal flange 212. The distal portion 216 has a cylindrical configuration, and has an outer diameter that is less than the outer diameter of the distal flange 212.

Upon discharge of the firearm 10, the projectile enters the first intermediate baffle 110*a* by way of the aperture 198 in the cone insert 196, after passing through the expansion chamber 402. The projectile subsequently enters, and travels through the expansion chamber 404, along the central axis of the blast baffle 109.

The blast baffle 109 is unitarily formed. In alternative embodiments, the various components of the blast baffle 109 can be formed separately, and can be joined by a suitable means such as welding.

Intermediate Baffles

The first, second, and third intermediate baffles 110*a*, 110*b*, 110*c* are substantially identical. Except where otherwise noted, the following description of the first intermediate baffle 110*a* applies equally to the second and third intermediate baffles 110*b*, 110*c*. The optimal number of intermediate baffles is application-dependent, and can vary with factors such as the degree of audible and visual suppression desired in a particular application. Thus, alternative embodiments of the suppressor 100 can be configured with more, or less than three intermediate baffles.

The first, second, and third intermediate baffles 110*a*, 110*b*, 110*c* are positioned within the outer can 102. As can be seen in FIG. 3, the first intermediate baffle 110*a* is located directly downstream, or distally, of the blast baffle 109. The second intermediate baffle 110*b* is located directly downstream of the first intermediate baffle 110*a*. The third intermediate baffle 110*c* is located directly downstream of the second intermediate baffle 110*b*.

Figure 13:
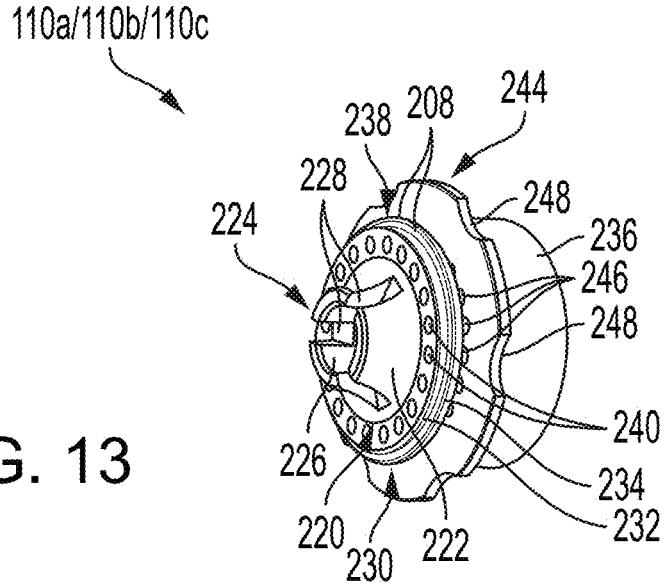
FIG. 13 is a rear perspective view of an intermediate baffle of the suppression system shown in FIGS. 1-3.
Figure 14:
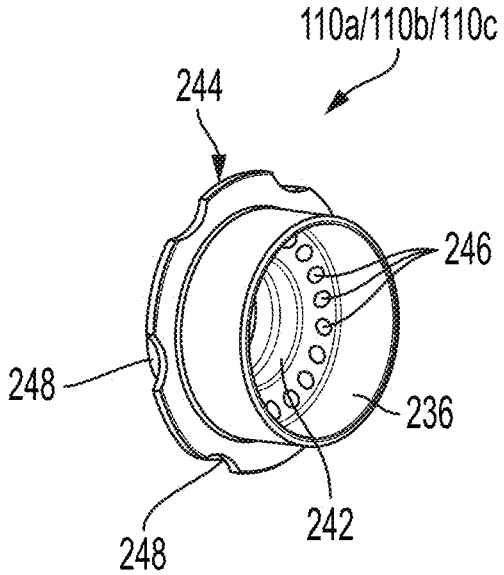
FIG. 14 is a front perspective view of the intermediate baffle shown in FIG. 13.

Referring to FIGS. 13 and 14, the first intermediate baffle 110*a* includes a cone insert 220 having an arcuate, or concave outer surface 222 that is symmetrically disposed about the central axis of the first intermediate baffle 110. For example, the arcuate outer surface 222 can be a concave curved surface with a proximal end portion that extends in a direction parallel or substantially parallel to the central axis of the first intermediate baffle 110*a*, and a distal end portion that extends in a direction orthogonal or substantially orthogonal to the central axis of first intermediate baffle 110.

The cone insert 220 extends distally, from a proximal end 224 of the first intermediate baffle 110*a*. An aperture 226 is formed in the cone insert 220. The aperture 226 of the first intermediate baffle 110*a* is aligned with the aperture 198 of the blast baffle 109, and has a diameter about equal to the diameter of the aperture 198. The aperture 226 of the second intermediate baffle 110*b* is aligned with the aperture 226 of the first intermediate baffle 110*a*. The aperture 226 of the third intermediate baffle 110*c* is aligned with the aperture 226 of the second intermediate baffle 110*b*. The apertures 226 form part of the bore 101.

The proximal end of the cone insert 220 includes a plurality of cutouts 228 formed therein. The cutouts 228 are located adjacent the aperture 226, and help to redirect some of the gas flow reaching the first intermediate baffle 110*a* into the aperture 226.

The first intermediate baffle 110*a* also includes a proximal flange 230. The proximal flange 230 adjoins, and extends downstream, or distally from the cone insert 220. The proximal flange 200 has an outward-facing circumferential surface 232; and a lip 234 that adjoins the circumferential surface 232. The circumferential surface 232 has a diameter that is slightly smaller than an inner diameter of the distal portion 216 of the blast baffle 109. Also, the diameter of the circumferential surface 232 is slightly smaller than an inner diameter of a distal portion 236 of the first intermediate baffle 110*a*.

The lip 234 and the circumferential surface 232 form a seat 238. As can be seen in FIG. 3, the seat 238 of the first intermediate baffle 110*a* accommodates the distal, or downstream end of the distal portion 216 of the blast baffle 109, with the downstream end of the distal portion 216 positioned over the circumferential surface 232, and abutting the lip 234. Similarly, the seat 238 of the second intermediate baffle 110*b* accommodates the end of a distal portion 236 of the first intermediate baffle 110*a*; and the seat 238 of the third intermediate baffle 110*c* accommodates the end of the distal portion 236 of the second intermediate baffle 110*b*.

A plurality of axially-oriented, circular through-wall ports 240 are formed in the proximal flange 230, with each through-wall port 240 being equally spaced from its adjacent through-wall port 240.

Referring to FIG. 3, the first intermediate baffle 110*a* and the second intermediate baffle 110*b* define an expansion chamber 408, or third expansion chamber, located between the first intermediate baffle 110*a* and the second intermediate baffle 110*b*. The second intermediate baffle 110*b* and the third intermediate baffle 110*c* likewise define an expansion chamber 410, or second expansion chamber, located between the second intermediate baffle 110*b* and the third intermediate baffle 110*c*. The third intermediate baffle 110*c* and the distal baffle 112 define an expansion chamber 412, or first expansion chamber, located between the third intermediate baffle 110*c* and the distal baffle 112.

In addition, the first intermediate baffle 110*a*, the second intermediate baffle 110*b*, and the outer can 102 define an expansion chamber 414, or ninth expansion chamber. As can be seen in FIG. 3, the expansion chamber 414 is located radially outward of the expansion chamber 408, and is separated from the expansion chamber 408, in part, by a distal portion 236 of the first intermediate baffle 110*a*. The second intermediate baffle 110*b*, the third intermediate baffle 110*c*, and the outer can 12 likewise define an expansion chamber 416, or tenth expansion chamber. The expansion chamber 416 is located radially outward of the expansion chamber 410, and is separated from the expansion chamber 410, in part, by a distal portion 236 of the second intermediate baffle 110*b*. The third intermediate baffle 110*c*, the distal baffle 112, and the outer can 102 define an expansion chamber 418, or eleventh expansion chamber. The expansion chamber 418 is located radially outward of the expansion chamber 412, and is separated from the expansion chamber 412, in part, by a distal portion 236 of the third intermediate baffle 110*c*.

The through-wall ports 240 in the proximal flange 230 of the first intermediate baffle 110*a* extend between, and facilitate fluid communication between the expansion chamber 404 and the expansion chamber 406. The through-wall ports 240 in the proximal flange 230 of the second intermediate baffle 110*b* extend between, and facilitate fluid communication between the expansion chamber 408 and the expansion chamber 414. The through-wall ports 240 in the proximal flange 230 of the third intermediate baffle 110*c* extend between, and facilitate fluid communication between the expansion chamber 410 and the expansion chamber 416.

The aperture 226 in the first intermediate baffle 110*a* extends between, and facilitates fluid communication between the expansion chamber 404 and the expansion chamber 408. The aperture 226 in the second intermediate baffle 110*b* extends between, and facilitates fluid communication between the expansion chamber 408 and the expansion chamber 410. The aperture 226 in the third intermediate baffle 110*c* extends between, and facilitates fluid communication between the expansion chamber 410 and the expansion chamber 412. Also, the apertures 226 in the first, second, and third intermediate baffles 110, 110*b*, 110*c* form part of the bore 101.

The first intermediate baffle 110*a* further includes a middle portion 242, visible in FIG. 14. The middle portion 242 adjoins, and extends distally from the proximal flange 230. The middle portion 242 has a cylindrical configuration.

The first intermediate baffle 110*a* also includes a distal flange 244, as can be seen in FIGS. 13 and 14. The distal flange 244 adjoins, and extends distally from the middle portion 242. The distal flange 244 has an outer diameter that is slightly smaller than an inner diameter of the outer can 102, so that minimal clearance exists between the distal flange 212 and the inner surface of the outer can 102.

A plurality of axially-oriented, circular through-wall ports 246 are formed in the distal flange 244. The through-wall ports 246 are located near the inner circumference of the distal flange 244, and each through-wall port 246 is equally spaced from its adjacent through-wall port 246. Each through-wall port 246 aligns with a corresponding through-wall port 240 in the proximal flange 230.

The through-wall ports 246 in the distal flange 244 of the first intermediate baffle 110*a* extend between, and facilitate fluid communication between the expansion chamber 406 and the expansion chamber 408. The through-wall ports 246 in the distal flange 244 of the second intermediate baffle 110*b* extend between, and facilitate fluid communication between the expansion chamber 414 and the expansion chamber 410. The through-wall ports 246 in the distal flange 244 of the third intermediate baffle 110*c* extend between, and facilitate fluid communication between the expansion chamber 416 and the expansion chamber 412.

Through-wall ports 248 are formed along the outer circumference of the distal flange 244. The through-wall ports 248 are equally spaced along the circumference of the distal flange 244. Each through-wall port 248 is bounded by an arcuate surface of the distal flange 244, so that the outer circumference of the distal flange 244 has a scalloped configuration.

The through-wall ports 248 in the distal flange 244 of the first intermediate baffle 110*a* extend between, and facilitate fluid communication between the expansion chamber 406 and the expansion chamber 414. The through-wall ports 248 in the distal flange 244 of the second intermediate baffle 110*b* extend between, and facilitate fluid communication between the expansion chamber 414 and the expansion chamber 416. The through-wall ports 248 in the distal flange 244 of the third intermediate baffle 110*c* extend between, and facilitate fluid communication between the expansion chamber 416 and the expansion chamber 418.

A proximal end of the distal portion 236 adjoins the distal flange 244, so that the distal portion 236 extends downstream, or distally from the distal flange 244. The distal portion 236 has a cylindrical configuration, and has an outer diameter that is less than the outer diameter of the distal flange 244.

Upon discharge of the firearm 10, the projectile enters the first intermediate baffle 110*a* by way of the aperture 226 in the cone insert 220 of the first intermediate baffle 110*a*, after passing through the expansion chamber 404 between the blast baffle 109 and the first intermediate baffle 110*a*. The projectile subsequently enters, and travels through the expansion chamber 408, along the central axis of the first intermediate baffle 110*a*.

After passing through the expansion chamber 408, the projectile enters the second intermediate baffle 110*b* by way of the aperture 226 in the cone insert 220 of the second intermediate baffle 110*b*. The projectile subsequently enters, and travels through the expansion chamber 410, along a central axis of the second intermediate baffle 110*b*.

After passing through the expansion chamber 410, the projectile enters the third intermediate baffle 110*c* by way of the aperture 226 in the third intermediate baffle 110*c*. The projectile subsequently enters, and travels through the expansion chamber 412.

The first, second, and third intermediate baffles 110*a*, 110*b*, 110*c* are unitarily formed. In alternative embodiments, the various components of the first, second, and third intermediate baffles 110*a*, 110*b*, 110*c* can be formed separately, and can be joined by a suitable means such as welding.

Distal Baffle

As can be seen in FIG. 3, the distal baffle 112 is located directly downstream, or distally, of the third intermediate baffle 110*c*, and is positioned within the outer can 102.

Figure 15:
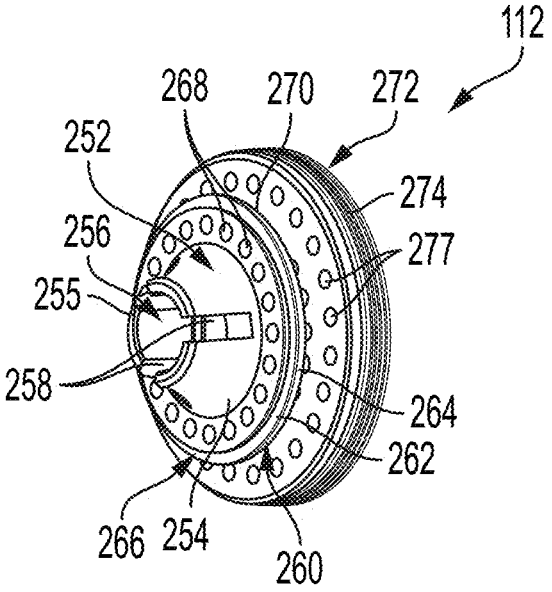
FIG. 15 is a rear perspective view of a distal baffle of the suppression system shown in FIGS. 1-3.
Figure 16:
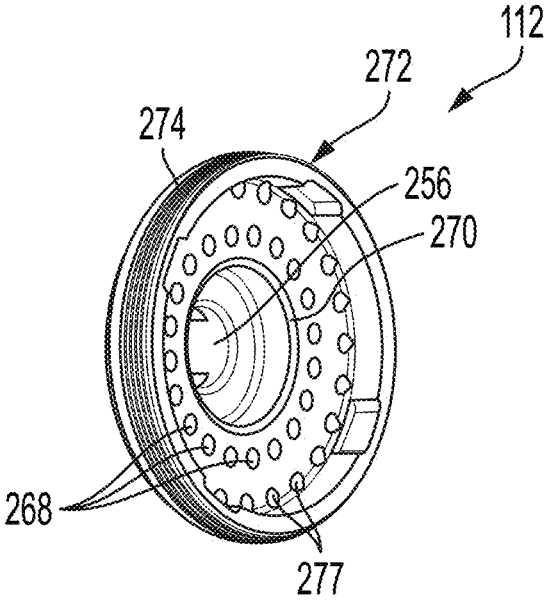
FIG. 16 is a front perspective view of the distal baffle shown in FIG. 15.

Referring to FIGS. 15 and 16, the distal baffle 112 includes a cone insert 252 having an arcuate, or concave outer surface 254 that is symmetrically disposed about the central axis of the distal baffle 112. For example, the arcuate outer surface 254 can be a concave curved surface with a proximal end portion that extends in a direction parallel or substantially parallel to the central axis of the distal baffle 112, and a distal end portion that extends in a direction orthogonal or substantially orthogonal to the central axis of distal baffle 112.

The cone insert 252 extends distally, from a proximal end 255 of the distal baffle 112. An aperture 256 is formed in the cone insert 252. The aperture 256 is aligned with the aperture 226 of the third intermediate baffle 110*c*, and has a diameter about equal to the diameter of the aperture 226. The aperture 256 forms part of the bore 101.

The proximal end of the cone insert 252 includes a plurality of cutouts 258 formed therein. The cutouts 258 are located adjacent the aperture 256, and help to redirect some of the gas flow reaching the distal baffle 112 into the aperture 256.

The distal baffle 112 also includes a proximal flange 260. The proximal flange 260 adjoins, and extends downstream, or distally from the cone insert 252. The proximal flange 260 has an outward-facing circumferential surface 262; and a lip 264 that adjoins the circumferential surface 262. The circumferential surface 262 has a diameter that is slightly smaller than an inner diameter of the distal portion 236 of the third intermediate baffles 110*c*.

The lip 264 and the circumferential surface 262 form a seat 266. As can be seen in FIG. 3, the seat 266 accommodates the downstream end of the distal portion 236 of the third intermediate baffle 110*c*, with the downstream end of the distal portion 236 positioned over the circumferential surface 262, and abutting the lip 264.

Referring again to FIGS. 15 and 16, a plurality of axially-oriented, circular through-wall ports 268 are formed in the proximal flange 260, with each through-wall port 268 being equally spaced from its adjacent through-wall port 268. The through-wall ports 268 extend between, and facilitate fluid communication between the expansion chamber 412 and the expansion chamber 418.

The distal baffle 112 further includes a middle portion 270. The middle portion 270 adjoins, and extends distally from the proximal flange 260. The middle portion 270 has a cylindrical configuration.

The distal baffle 112 also includes a distal flange 272. The distal flange 272 adjoins, and extends distally from the middle portion 270. Threads 274 are formed along an outer circumference of the distal flange 272. The distal baffle 112 is configured so that the threads 274 engage the threads 126 on the proximal end 122 of the outer can 102 to secure the distal flange 272 to the outer can 102. Once the distal baffle 112 has been tightened onto the outer can 102 so as to pre-stress the distal portion 16 of the barrel 12 (as discussed below), the distal baffle 112 can be welded to the outer can 102 to secure the distal baffle 112 in place.

A plurality of axially-oriented, circular through-wall ports 276 are formed in the distal flange 272, with each through-wall port 276 being equally spaced from its adjacent through-wall port 276. The through-wall ports 276 are located near the inner circumference of the distal flange 272. Each of the through-wall ports 276 aligns with a respective one of the through-wall ports 268 in the proximal flange 260.

A plurality of axially-oriented, circular through-wall ports 277 are formed in the distal flange 272. The through-wall ports 277 are located near the outer circumference of the distal flange 272, and are equally spaced in circumferential direction.

The distal baffle 112, the outer can 102, and the end cap 114 define an expansion chamber 420, or twelfth expansion chamber, located between the distal baffle 112 and the end cap 114. The through-wall ports 276 extend between, and facilitate fluid communication between the expansion chamber 418 and the expansion chamber 420. The through-wall ports 277 likewise extend between, and facilitate fluid communication between the expansion chamber 418 and the expansion chamber 420. The aperture 256 in the cone insert 252 extends between, and facilitates fluid communicant between the expansion chamber 412 and the expansion chamber 420.

Upon discharge of the firearm, the projectile enters the distal baffle 112 by way of the aperture 256 in the cone insert 252, after passing through the expansion chamber 412 between the third intermediate baffle 110*c* and the distal baffle 112. The projectile subsequently enters, and travels through the expansion chamber 420, toward the end cap 114.

The distal baffle 112 is unitarily formed. In alternative embodiments, the various components of the distal baffle 112 can be formed separately, and can be joined by a suitable means such as welding.

End Cap

As can be seen in FIG. 3, the end cap 114 is located directly downstream, or distally, of the distal baffle 112, and is positioned within the outer can 102.

Figure 17:
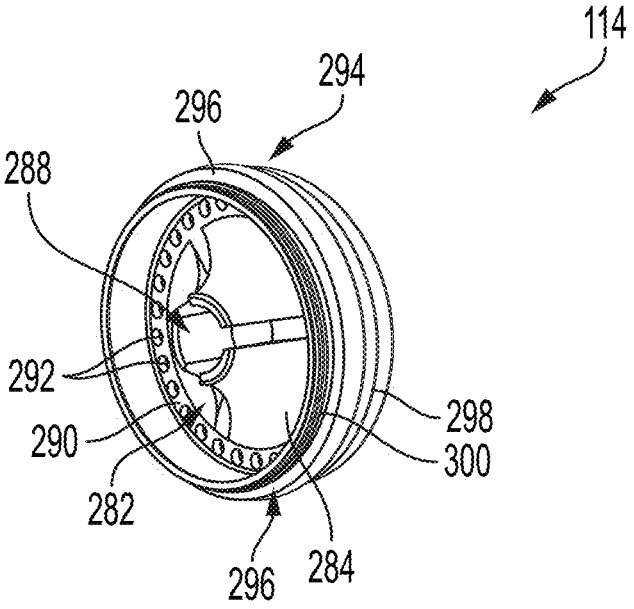
FIG. 17 is a rear perspective view of an end cap of the suppression system shown in FIGS. 1-3.
Figure 18:
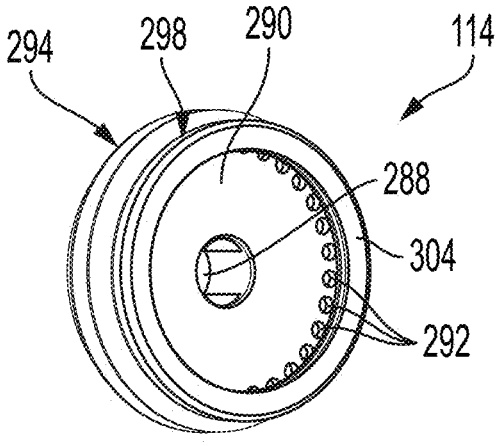
FIG. 18 is a front perspective view of the end cap shown in FIG. 17.

Referring to FIGS. 17 and 18, the end cap 114 incudes a cone insert 282 having an arcuate, or concave outer surface 284 that is symmetrically disposed about the central axis of the end cap 114. For example, the arcuate outer surface 284 can be a concave curved surface with a proximal end portion that extends in a direction parallel or substantially parallel to the central axis of the distal baffle 112, and a distal end portion that extends in a direction orthogonal or substantially orthogonal to the central axis of distal baffle 112.

The cone insert 282 extends distally, from a proximal end 286 of the end cap 114. An aperture 288 is formed in the cone insert 282. The aperture 288 is aligned with the aperture 256 of the distal baffle 112, and has a diameter about equal to the diameter of the aperture 256. The aperture 288 forms part of the path of the bore 101.

The proximal end of the cone insert 282 includes a plurality of cutouts 283 formed therein. The cutouts 283 are located adjacent the aperture 288, and help to redirect some of the gas flow reaching the end cap 114 into the aperture 288.

The end cap 114 further includes a body 290. The cone insert 282 adjoins, and extends proximally, i.e., upstream, from a proximal end of the body 290. The aperture 288 defined by the cone insert 282 extends through body 290, so that the aperture 288 in fluid communication with the ambient environment around the firearm 10. The aperture 288 thus extends between, and facilitates fluid communication between the expansion chamber 420 and the ambient environment.

A plurality of axially-oriented, circular through-wall ports 292 are formed in the body 290, with each through-wall port 292 being equally spaced from its adjacent through-wall port 292. The through-wall ports 292 are located near the outer circumference of the body 290. The through-wall ports 292 extend between, and facilitate fluid communication between the expansion chamber 420 and the ambient environment.

The end cap 114 also includes a flange 294. The flange 294 adjoins, and circumscribes the body 290. The flange 294 includes a proximal portion 296, and a distal portion 298. Threads 300 are formed on, and extend along an outer circumference of the proximal portion 296. The end cap 114 is configured so that the threads 300 engage the threads 126 on the proximal end 122 of the outer can 102 to secure the end cap 114 to the outer can 102.

The proximal portion 296 has a circumferentially-extending end face 302 that faces in the proximal, or upstream direction. The end face 302 engages a forward, or distal end of the outer can 102 as the end cap 114 is tightened, and thus acts as a rotational stop. Also, friction between the end face 302 and the distal end of the outer can 102 helps to retain the end cap 114 on the outer can 102.

The distal portion 298 of the flange 294 also includes a lip 304 that forms a distal end of the flange 294. The lip 304 extends inward from the outer circumference of the distal portion 298, so that the lip 304 aligns with, i.e., is located immediately downstream of, the through-wall ports 292.

Upon discharge of the firearm, the projectile enters the aperture 288 in end cap 114 after passing thought the expansion chamber 420. The projectile then passes through the aperture and exits the suppressor 100.

The end cap 114 is unitarily formed. In alternative embodiments, the various components of the end cap 114 can be formed separately, and can be joined by a suitable means such as welding.

Expansion Chambers

The configuration of the suppressor 100 reduces the audible signature, i.e., the audible report; and the visual signature, i.e., the muzzle flash, of the firearm 10. This is accomplished by the reduction in pressure of the exhaust gas that occurs as the exhaust gas travels through the various expansion chambers within the suppressor 100. The suppressor 100 is configured to be mounted on a barrel 12 of the firearm 10, and to divert exhaust generated from the firing of a projectile from the firearm 10 into multiple, separate expansion chambers. More specifically, as the projectile travels through a bore 101 of the suppressor 100, e.g., an extended aligned aperture extending through suppressor 100, the exhaust gas diverts into different expansion chambers of suppressor 100, which in turn causes the exhaust gas to lose velocity and pressure along the path of the projectile through the bore.

Referring to FIG. 3, the projectile, and the high-pressure exhaust gas that propels the projectile, enter the suppressor 100 by way of the bore 24 in the barrel 12, and the second aperture 176 in the internal mount 106. The projectile and the exhaust gas enter the expansion chamber 403 defined by the body 152 of the internal mount 106. The exhaust gas expands, and thereby undergoes a reduction in pressure, within the expansion chamber 403.

The exhaust gas exits the expansion chamber 403 and flows into the expansion chamber 402, where the exhaust gas undergoes further expansion and further reduction in pressure. The exhaust gas enters the expansion chamber 402 by way of the through-wall ports 180 and the aperture 172 in the body 152 of the internal mount 106.

From the expansion chamber 402, a portion of the exhaust gas is diverted into the expansion chamber 400 by way of the through-wall ports 158 in the flange 150 of the internal mount 106; the through-wall ports 148 in the outer can 102; and the through-wall ports 208 in the proximal flange 200 of the blast baffle 109. The flow of exhaust gas to the expansion chamber 400 helps to equalize the gas pressures in the expansion chamber 402 and the expansion chamber 400, and allows the gas to further expand and undergo a further reduction in pressure in the expansion chamber 400. The remaining exhaust gas enters the expansion chamber 404 by way of the aperture 198 in the blast baffle 109, and undergoes further expansion in the expansion chamber 404.

From the expansion chamber 400, a portion of the exhaust gas enters the expansion chamber 404 by way of the through-wall ports 213 in the distal flange 212 of the blast baffle 109. The remaining exhaust gas from the expansion chamber 400 enters the expansion chamber 414 by way of the through-wall ports 214 in the distal flange 212. The exhaust gas undergoes further expansion in the expansion chamber 404, 314.

The expansion chamber 404 and the expansion chamber 406 are in fluid communication by way of the through-wall ports 240 in the proximal flange 230 of the first intermediate baffle 110*a*. The through-wall ports 240 permit exhaust gas to flow between the expansion chamber 404 and the expansion chamber 406, and thus facilitate equalization of the pressure between the expansion chamber 404 and the expansion chamber 406.

The exhaust gas in the expansion chamber 406 flows to the adjacent expansion chamber 414 by way of through-wall ports 248 in the distal flange 244 of the first intermediate baffle 110*a*. The exhaust gas in the expansion chamber 406 also flows to the expansion chamber 408 by way of the through-wall ports 246 in the distal flange 244 of the first intermediate baffle 110*a*. The exhaust gas in the expansion chamber 404 flows to the expansion chamber 408 by way of the aperture 198 in the first intermediate baffle 110*a*. The exhaust gas, upon entering the expansion chambers 408, 414, undergoes further expansion and a further reduction in pressure.

The expansion chamber 408 and the expansion chamber 414 are in fluid communication by way of the through-wall ports 240 in the proximal flange 230 of the second intermediate baffle 110*b*. The through-wall ports 240 permit exhaust gas to flow between the expansion chamber 408 and the expansion chamber 414, and thus facilitate equalization of the pressure between the expansion chamber 408 and the expansion chamber 414.

The exhaust gas in the expansion chamber 414 flows to the adjacent expansion chamber 416 by way of through-wall ports 248 in the distal flange 244 of the second intermediate baffle 110*b*. The exhaust gas in the expansion chamber 414 also flows to the expansion chamber 410 by way of the through-wall ports 246 in the distal flange 244 of the second intermediate baffle 110*b*. The exhaust gas in the expansion chamber 408 flows to the expansion chamber 410 by way of the aperture 198 in the second intermediate baffle 110*b*. The exhaust gas, upon entering the expansion chambers 410, 416, undergoes further expansion and a further reduction in pressure.

The expansion chamber 410 and the expansion chamber 416 are in fluid communication by way of the through-wall ports 240 in the proximal flange 230 of the third intermediate baffle 110*c*. The through-wall ports 240 permit exhaust gas to flow between the expansion chamber 410 and the expansion chamber 416, and thus facilitate equalization of the pressure between the expansion chamber 410 and the expansion chamber 416.

The exhaust gas in the expansion chamber 416 flows to the adjacent expansion chamber 418 by way of through-wall ports 248 in the distal flange 244 of the third intermediate baffle 110*c*. The exhaust gas in the expansion chamber 416 also flows to the expansion chamber 412 by way of the through-wall ports 246 in the distal flange 244 of the third intermediate baffle 110*c*. The exhaust gas in the expansion chamber 410 flows to the expansion chamber 412 by way of the aperture 198 in the third intermediate baffle 110*c*. The exhaust gas, upon entering the expansion chambers 412, 418, undergoes further expansion and a further reduction in pressure.

The expansion chamber 412 and the expansion chamber 418 are in fluid communication by way of the through-wall ports 268 in the proximal flange 260 of the distal baffle 112. The through-wall ports 268 permit exhaust gas to flow between the expansion chamber 412 and the expansion chamber 418, and thus facilitate equalization of the pressure between the expansion chamber 412 and the expansion chamber 418.

The exhaust gas in the expansion chamber 418 flows to the adjacent expansion chamber 420 by way of the through-wall ports 276 and the through-wall ports 277 in the distal flange 272 of the distal baffle 112. The exhaust gas in the expansion chamber 412 flows to the expansion chamber 420 by way of the aperture 256 in the distal baffle 112. The exhaust gas, upon entering the expansion chamber 420, undergoes further expansion and a further reduction in pressure.

From the expansion chamber 420, the exhaust gas exits the suppressor 100 by way of the aperture 288, and the through-wall ports 292. As a result of the expansion of the exhaust gas that occurred progressively as the exhaust gas flowed through the various expansion chambers of the suppressor 100, pressure of the exhaust gas as the point it exits the suppressor is substantially lower than the pressure at which the exhaust gas entered the suppressor.

For example, the pressure of the exhaust gas may decrease by about 10% or more as the exhaust gas flows through each expansion chamber of the suppressor 100. Also, the exhaust gas is distributed evenly across the cross-section of the suppressor 100 due to the equal spacing between the various through-wall ports described above.

The reduction in the pressure of the exhaust gas exiting the suppressor 100 results in a reduction in audible report of a shot of the firearm 10. For example, the audible report may be reduced to less than about 150 DB, less than about 140 DB, less than about 130 DB, less than about 120 DB, less than about 110 DB, or less than about 110 DB. Also, the suppressor 100 may provide a sound reduction of, for example, at least 10 DB, at least 15 DB, at least 20 DB, at least 25 DB, at least 30 DB, at least 35 DB, at least 40 DB, at least 45 DB, at least 50 DB, at least 55 DB, or at least 60 DB in relation to the same firearm operating in an unsuppressed condition. Also, the suppressor 100 may also reduce the recoil of the firearm 10 by up to 30 percent, up to 40 percent, up to 50 percent, or more, in relation to the same firearm operating in an unsuppressed condition. Also, the suppressor 100 may reduce the muzzle flash of the firearm 10. For example, the suppressor 100 may reduce the muzzle flash of the firearm 10 by up to 30 percent, up to 40 percent, up to 50 percent, or more, in relation to the same firearm operating in an unsuppressed condition.

Barrel, Barrel Pre-Stress

Referring to FIGS. 1-4, the barrel 12 comprises a first, or proximal portion 14, an adjoining third, or intermediate portion 15; and the second, or distal portion 16, which adjoins the intermediate portion 15. The proximal portion 14 has exterior threads 20 formed on a proximal end thereof. The exterior threads 20 are configured to engage corresponding internal threads on a trunnion secured to the receiver of the firearm 10, to secure the barrel 12 to the receiver.

As also can be seen in FIG. 3, the bore 24 of the barrel 12 extends the entire length of the barrel 12, and has a substantially constant diameter along its length. The bore 24 is aligned with the chamber of receiver so that the projectile, after exiting the chamber upon discharge of the firearm 10, enter the proximal end of the bore 24 and travels through the bore 24. After passing through the bore 24 and exiting the distal end of the bore 24, the projectile enters the bore 101 of the suppressor 100 by way of the internal mount 106. The high-pressure exhaust gas that propels the projectile likewise travels from the expansion chamber and into the suppressor 100 by way of the bore 24.

The outer diameter of the proximal portion 14 is greater than the outer diameter of the intermediate portion 15. The outer diameter of the intermediate portion likewise is greater than the outer diameter of the distal portion 16. Thus, as can be seen in FIG. 3, because the diameter of the bore 24 is substantially constant along its length, the wall thickness of the barrel 12 varies between the proximal portion 14, the intermediate portion 15, and the distal portion 16, with the wall thickness of the distal portion 16 being less than that of the proximal portion 14 and the intermediate portion 15. More specifically, the wall thickness of the distal portion 16, on which the suppressor 100 is mounted, is reduced to lower the weight of the barrel 12 so that the addition of the suppressor 100 does not substantially change the mass and balance of the firearm 10 in relation to the same firearm equipped with a conventional barrel, with no suppressor.

For example, the wall thicknesses of the distal portion 16, the intermediate portion 15, and the proximal portion 14 of the barrel 12 can vary. The suppressor 100 can have a weight of, for example, about four pounds, and the thinning of the distal portion 16 of the barrel 12 can reduce the weight of the barrel 12 by about, for example, four pounds, in relation to a comparable conventional barrel.

The configuration of the suppressor 100 increases the rigidity of the distal portion of the barrel 12, to counteract the decrease in strength resulting from the thinning of the distal portion 16. More specifically, the mechanical interaction between the suppressor 100 and the barrel 12 places a compressive load on the distal portion 16, with the compressive load acting in the axial direction of the barrel 12. The compressive load compresses, and pre-stresses the distal portion 16 of the barrel 12 in a manner that helps to counteract the stresses that develop in the distal portion 16 when the firearm 10 is discharged and the projectile, along with the high-pressure gas that propels the projectile, travel through the bore 24 of the barrel 12.

The compressive load on the distal portion 16 is generated as follows. As can be seen in FIG. 3, the suppressor 100 is connected to the barrel 12 by way of the external mount 104 and the internal mount 106. More specifically, the external mount 104 is rigidly connected to a proximal end 32 of the distal portion 16 of the barrel 12 as discussed above; and the internal mount 106 rigidly connected to the distal end 30 of the distal portion 16 also as discussed above.

Moreover, the internal mount 106 is mechanically coupled to the distal baffle 112 by way of the first, second, and third intermediate baffles 110*a*, 110*b*, 100*c*; the blast baffle 109; and the inner can 108. And the distal baffle 112 is threadably coupled to the distal end of the outer can 102 by the threads 274 on the distal baffle 112 and the threads 126 on the outer can. Thus, rotation the distal baffle 112, and the resulting the tightening of the distal baffle 112 onto the outer can 102, causes the distal baffle 112 to translate in the proximal direction in relation to the outer can 102. The distal baffle 112, as it translates, urges the adjacent third intermediate baffle 110*c* in the proximal direction, which in turn urges the second intermediate baffle 110*b*, the first intermediate baffle 110*a*, blast baffle 109, the inner can 108, and the internal mount 106 in the proximal direction, and causes these components to translate linearly, in the proximal direction.

The internal mount 106 is rigidly connected to the distal end 30 of the distal portion 16 of the barrel 12. Thus, the tightening the of the distal baffle 112 onto the outer can 102 ultimately causes the internal mount 106 to exert an axial force on the distal end of the distal portion 16, with the force acting in the proximal direction. The distal baffle 112, the first, second, and third intermediate baffles 110*a*, 110*b*, 110*c*, the blast baffle 109, and the inner can 108 thus act as a baffle stack that transmits the reactive force exerted on the distal baffle 112 by the outer can 102 as the distal baffle 112 is screwed onto the outer can 102.

In addition, a reactive force is exerted on the outer can 102 by the distal baffle 112 as the distal baffle 112 is tightened onto the outer can 102. This reactive force draws the outer can 102, and the attached external mount 104, in the distal direction. The external mount 104 is rigidly connected to the proximal end 32 of the distal portion 16 of the barrel 12. Thus, the tightening of the distal baffle 112 places the outer can 102 and the external mount 104 under tension, which in turn causes the external mount 104 to transmit, and exert a force on the proximal end of the distal portion 16, with the force acting in the distal direction, i.e., in a direction opposite the direction in which the internal mount 106 exerts the axial force on the distal end of the distal portion 16. This force, in combination with the opposing force exerted by the internal mount 106 on the distal end of the distal portion 16, subjects to the distal portion 16 to compression. The compression of the distal portion 16, in effect, pre-stresses the distal portion 16 and thereby increases the rigidity, and the tensile strength, of the distal portion 16. The increased rigidity, in turn, counteracts the stresses that normally occur in the barrel 12 as the projectile and the high-pressure exhaust gasses travel through the bore 24 of the barrel 12 upon discharge of the firearm. For example, it is believed that pre-stressing the distal portion 16 in the above manner can increase the rigidity of the distal portion 16 by up to about 70 percent.

The reduced maximum stress in the distal portion 16 of the barrel 12 resulting from the pre-stress imparted by the suppressor 100 allows the wall thickness of the distal portion 16 to be reduced, without adversely affecting the structural integrity of the barrel 12. This reduction in wall thickness produces a corresponding reduction in the weight of the distal portion 16. The weight reduction in the distal portion 16, in turn, offsets the weight of the suppressor 100. Thus, the suppressor 100, along with the barrel 12, can be added to the firearm 10 without substantially affecting the weight or the balance of the firearm 10 in comparison to the same firearm equipped with a conventional barrel, and without a suppressor. The suppressor 100, in conjunction with the barrel 12, thus permit the firearm 10 to operate in a suppressed state, without the adverse impact to the weight and balance of the firearm 10 that normally accompany the use of a suppressor. For example, in an application where the suppressor 100 is configured for use with an M2HB Browning machine gun, it is believed that the thinning of the distal portion of the barrel can reduce the weight of the barrel by about four pounds, which is about equal to the weight of the suppressor 100 when configured for such an application.

Although certain features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents. Likewise, while certain methodologies for directed exhaust through a suppressor are disclosed herein, the disclosed methods are not limited to the particular order of the steps in the methods described herein. Instead, one or more of the steps of one or more of the methodologies described herein may be in a different order or may not be performed at all according to some embodiments. Further, additional steps may also be completed at any point during the methods of directing exhaust through the suppressor as described herein.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or methods are in any way required for one or more implementations or that these features, elements, and/or methods are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

All references cited and/or discussed in this specification are incorporated herein by reference in their entireties and to the same extent as if each reference was individually incorporated by reference.

What is claimed is:

1. A suppression system for a firearm, comprising:

a barrel having a first portion and a second portion, wherein: the first portion and the second portion define a bore configured to receive a projectile upon discharge of the firearm; and a wall thickness of the second portion of the barrel is less than a wall thickness of the first portion of the barrel; and a suppressor comprising:

a first mount configured to be connected to a first end of the second portion of the barrel;

a second mount configured to be connected to a second end of the second portion of the barrel;

a cylindrical outer body connected to the second mount; and a first baffle and a second baffle disposed within the outer body and defining an expansion chamber in fluid communication with the bore, wherein the first and second baffles are coupled to the outer body and the second mount so that the first and second baffles are configured to translate in relation to the outer body, and the translation of the first and second baffles in relation to the outer body urges the first mount toward the second mount.

2. The system of claim 1, wherein the urging of the first mount toward the second mount compresses the second portion of the barrel.

3. The system of claim 1, wherein the second baffle is configured to be threadably coupled to the outer body so that rotation of the second baffle in relation to the outer body causes the first and the second baffles to translate linearly in relation to the outer body.

4. The system of claim 3, wherein the rotation of the second baffle in relation to the outer body causes the first and the second baffles to translate in a first direction in relation the outer body, and produces a force on the outer body acting in a second direction opposite the first direction.

5. The system of claim 4, wherein the force on the outer body is transmitted to the second end of the second portion of the barrel by way of the second mount, and urges the second end of the distal portion of the barrel in the second direction.

6. The system of claim 4, wherein the force on the outer body places the outer body in tension.

7. The system of claim 1, wherein the suppressor further comprises a cylindrical inner can attached to the first mount and coupled to the second baffle, the inner can being configured to urge the first mount toward the second mount.

8. The system of claim 7, wherein:

the expansion chamber is a first expansion chamber; and the suppressor further comprises:

a third baffle coupled to the second baffle, the second and third baffles defining a second expansion chamber in fluid communication with first expansion chamber;

a fourth baffle coupled to the third baffle, the third and fourth baffles defining a third expansion chamber in fluid communication with second expansion chamber; and a fifth baffle coupled to the fourth baffle, the fourth and fifth baffles defining a fourth expansion chamber in fluid communication with third expansion chamber.

9. The system of claim 8, wherein the inner can, the second mount, and the fifth baffle define a fifth expansion chamber in fluid communication with the fourth expansion chamber.

10. The system of claim 9, wherein the first mount defines a sixth expansion chamber in fluid communication with the fifth expansion chamber and the bore of the barrel.

11. The system of claim 10, wherein the outer body, the inner can, the second mount, and the fifth baffle define a seventh expansion chamber in fluid communication with the fourth expansion chamber and the fifth expansion chamber.

12. The system of claim 11, wherein:

the fourth baffle, the fifth baffle, and the outer body define an eighth expansion chamber located radially outward of the fourth expansion chamber and in fluid communication with the third, fourth, and seventh expansion chambers;

the third baffle, the fourth baffle, and the outer body define a ninth expansion chamber located radially outward of the third expansion chamber and in fluid communication with the second, third, and eighth expansion chambers;

the second baffle, the third baffle, and the outer body define a tenth expansion chamber located radially outward of the second expansion chamber and in fluid communication with the first, second, and ninth expansion chambers; and the first baffle, the second baffle, and the outer body define an eleventh expansion chamber located radially outward of the first expansion chamber and in fluid communication with the first and tenth expansion chambers.

13. The system of claim 12, wherein the suppressor further comprises an end cap connected to the outer body, wherein the end cap and the first baffle define a twelfth expansion chamber in fluid communication with the first and the tenth expansion chambers.

14. The system of claim 1, wherein: the first and second baffles define a bore configured to receive the projectile upon discharge of the firearm; and the bore defined by the suppressor is aligned with, and is in fluid communication with the bore defined by the barrel.

15. The firearm of claim 1, wherein the first end of the second portion of the barrel is a muzzle of the barrel.

16. The firearm of claim 15, wherein the first portion of the barrel is configured to be connected to a receiver of the firearm.

17. A firearm comprising the suppression system of claim 1.

* * * * *